US007607478B2

(12) United States Patent
Martinez et al.

(10) Patent No.: US 7,607,478 B2
(45) Date of Patent: Oct. 27, 2009

(54) INTERVENTION TOOL WITH OPERATIONAL PARAMETER SENSORS

(75) Inventors: Ruben Martinez, Houston, TX (US); Matthew Billingham, Houston, TX (US); Todor Sheiretov, Houston, TX (US); Paul Beguin, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 206 days.

(21) Appl. No.: 11/380,690

(22) Filed: Apr. 28, 2006

(65) Prior Publication Data

US 2007/0251687 A1 Nov. 1, 2007

(51) Int. Cl.
*E21B 47/01* (2006.01)

(52) U.S. Cl. ..... 166/250.01; 166/385; 166/53; 166/66

(58) Field of Classification Search ..... 166/250.04, 166/250.01, 385–387, 53, 64, 66; 175/24, 175/40

See application file for complete search history.

(56) References Cited

U.S. PATENT DOCUMENTS

| | | | | | |
|---|---|---|---|---|---|
| 4,102,394 | A | * | 7/1978 | Botts | 166/66 |
| 5,033,549 | A | | 7/1991 | Champeaux | |
| 5,115,860 | A | | 5/1992 | Champeaux | |
| 5,224,547 | A | | 7/1993 | Burns | |
| 5,228,507 | A | | 7/1993 | Obrejanu | |
| 5,310,001 | A | | 5/1994 | Burns | |
| 5,322,118 | A | | 6/1994 | Terrell | |
| 5,398,753 | A | | 3/1995 | Obrejanu | |
| 5,575,331 | A | | 11/1996 | Terrell | |
| 5,592,991 | A | | 1/1997 | Lembcke | |
| 5,636,689 | A | | 6/1997 | Rubbo | |
| 5,675,088 | A | * | 10/1997 | Serata | 73/784 |
| 5,778,980 | A | | 7/1998 | Comeau | |
| 5,947,213 | A | | 9/1999 | Angle | |
| 6,029,744 | A | | 2/2000 | Baird | |
| 6,041,856 | A | * | 3/2000 | Thrasher et al. | 166/53 |
| 6,196,309 | B1 | | 3/2001 | Estilette | |
| 6,206,108 | B1 | * | 3/2001 | MacDonald et al. | 175/24 |
| 6,257,332 | B1 | * | 7/2001 | Vidrine et al. | 166/250.15 |
| 6,281,489 | B1 | * | 8/2001 | Tubel et al. | 250/227.14 |
| 6,868,901 | B2 | | 3/2005 | Mason | |
| 7,219,747 | B2 | * | 5/2007 | Gleitman et al. | 175/40 |
| 7,246,662 | B2 | * | 7/2007 | Jabusch et al. | 166/250.15 |
| 2003/0164240 | A1 | | 9/2003 | Vinegar | |
| 2005/0145415 | A1 | | 7/2005 | Doering | |
| 2005/0217350 | A1 | * | 10/2005 | Jabusch et al. | 73/64.55 |
| 2006/0254768 | A1 | * | 11/2006 | De Jesus et al. | 166/255.1 |
| 2006/0272809 | A1 | * | 12/2006 | Tubel et al. | 166/250.01 |

FOREIGN PATENT DOCUMENTS

| | | | |
|---|---|---|---|
| GB | 2330598 | A | 4/1999 |
| WO | 9812418 | A | 3/1998 |

* cited by examiner

*Primary Examiner*—Shane Bomar
(74) *Attorney, Agent, or Firm*—Rodney Warfford; David Cate; Jaime Castano

(57) ABSTRACT

An intervention tool for use inside a wellbore is provided that includes an intervention module capable of performing an intervention operation downhole, and a drive electronics module in communication with the intervention module and configured to control the intervention module. The tool also includes one or more sensors which measure at least one operational parameter of the intervention operation during the intervention operation. The intervention operation is optimized based on the measured at least one operational parameter.

34 Claims, 2 Drawing Sheets

INTERVENTION TOOL WITH OPERATIONAL PARAMETER SENSORS

FIELD OF THE INVENTION

The present invention relates generally to a downhole intervention tool, and more particularly to such a tool having one or more sensors for measuring one or more operational parameters of an intervention operation.

BACKGROUND

The following descriptions and examples are not admitted to be prior art by virtue of their inclusion within this section.

A wide variety of downhole tools may be used within a wellbore in connection with producing hydrocarbons from oil and gas wells. Downhole tools such as frac plugs, bridge plugs, and packers, for example, may be used to seal a component against a casing along the wellbore wall or to isolate one pressure zone of formation from another. In addition, perforating guns may be used to create perforations through the casing and into the formation to produce hydrocarbons.

Often times, however, it is desirable to use a downhole tool to perform various intervention operations, which maintain and/or optimize the production of a well. Existing tools are used to perform a variety of intervention operations. However, these tools are not capable of monitoring operational parameters during an intervention operation. Instead, with previous intervention tools, a desired operational parameter is measured by a separate tool, which measures the desired operational parameter only after the intervention operation is completed. As such, an operator may not know if an intervention operation is successful or not until after the operation is complete.

Accordingly, a need exists for a downhole tool for performing an intervention operation, which includes one or more sensors for measuring operational parameters of the intervention operation.

SUMMARY

In one embodiment, the present invention is an intervention tool for use inside a wellbore that includes an intervention module capable of performing an intervention operation downhole, and a drive electronics module in communication with the intervention module and configured to control the intervention module. The tool also includes one or more sensors which measure at least one operational parameter of the intervention operation during the intervention operation. The intervention operation is optimized based on the measured at least one operational parameter.

In another embodiment, the present invention is a method for performing an intervention operation that includes providing an intervention tool having one or more sensors; deploying the intervention tool downhole to a desired location in a wellbore; operating the intervention tool to perform an intervention operation; measuring at least one operational parameter during the intervention operation by use of the one or more sensors; and optimizing the intervention operation based on the measured at least one operational parameter.

In yet another embodiment, the present invention is a method for performing an intervention operation that includes providing an intervention tool having one or more sensors; deploying the intervention tool downhole to a desired location in a wellbore; operating the intervention tool to perform an intervention operation; measuring at least one operational parameter during the intervention operation by use of the one or more sensors; and monitoring the progress of the intervention operation based on the measured at least one operational parameter.

The claimed subject matter is not limited to embodiments that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

Implementations of various technologies will hereafter be described with reference to the accompanying drawings. It should be understood, however, that the accompanying drawings illustrate only the various implementations described herein and are not meant to limit the scope of various technologies described herein.

DETAILED DESCRIPTION OF EMBODIMENTS OF THE INVENTION

Figure 1:
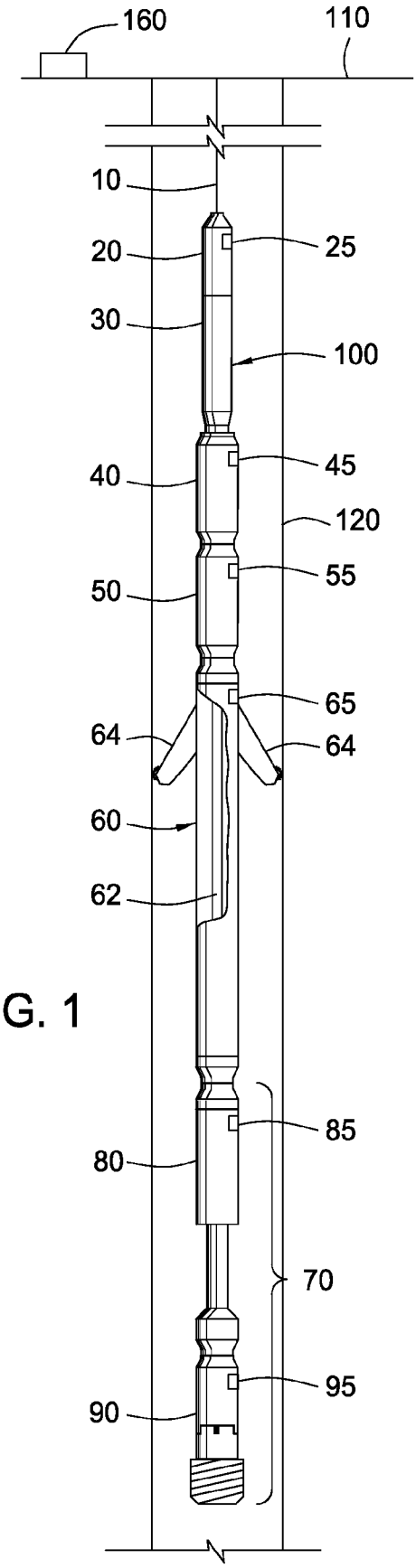
FIG. 1 is a schematic representation of an intervention tool for performing an intervention operation according to one embodiment of the present invention.
Figure 2:
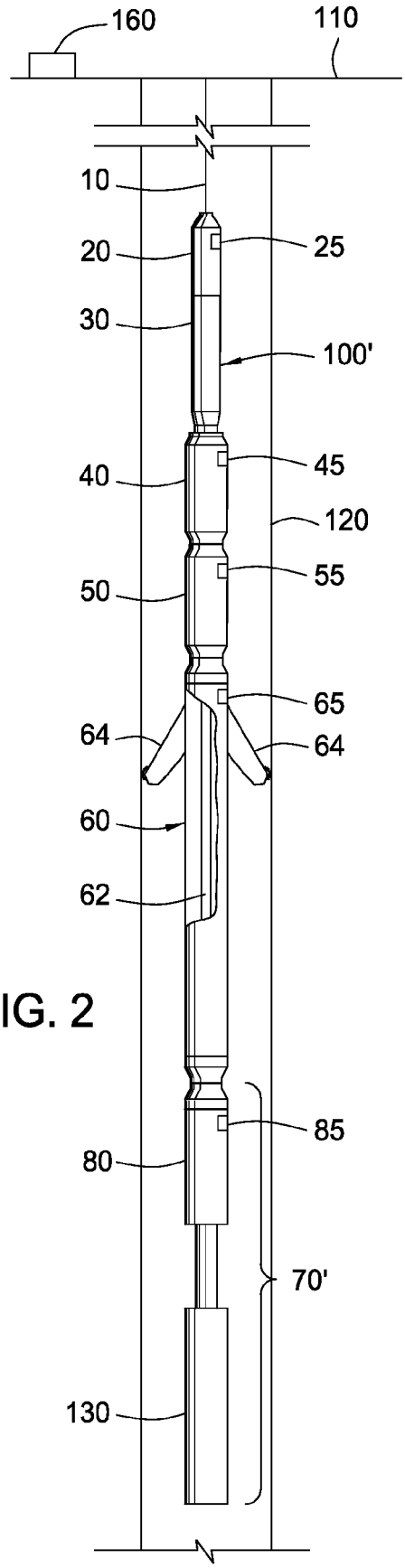
FIG. 2 is a schematic representation of an intervention tool for performing an intervention operation according to another embodiment of the present invention.
Figure 3:
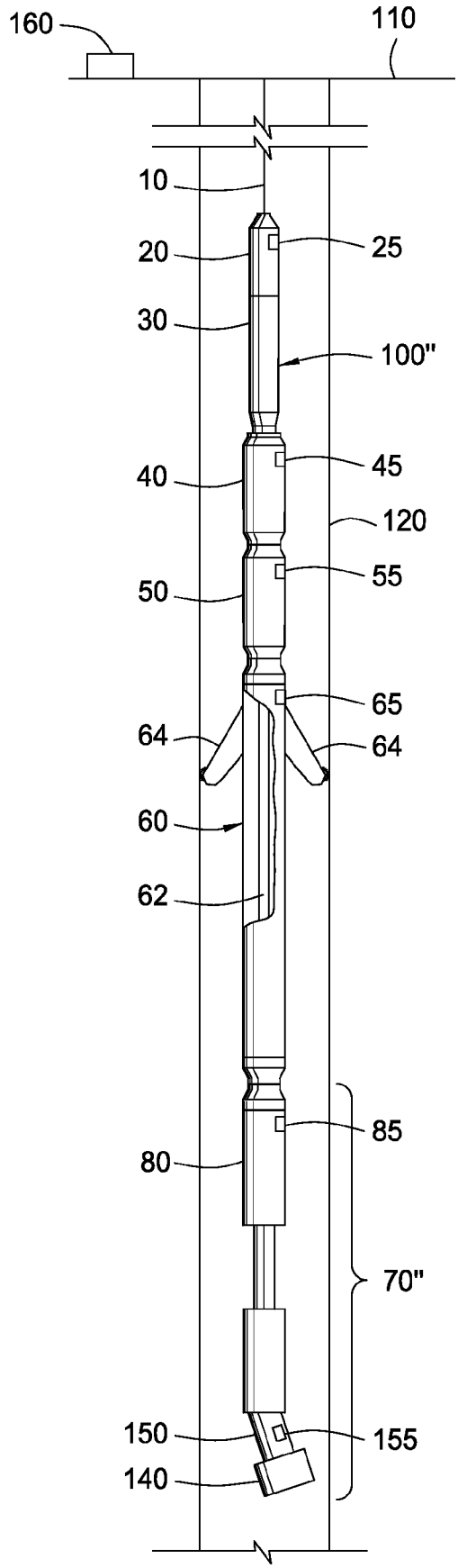
FIG. 3 is a schematic representation of an intervention tool for performing an intervention operation according to yet another embodiment of the present invention.

As shown in FIGS. 1-3, embodiments of the present invention are directed to an intervention tool for performing an intervention operation, which includes one or more sensors for measuring one or more operational parameters. In various embodiments of the invention, the operational parameters may be measured during an intervention operation. In addition, the measured operational parameters may be sent to a surface system at the surface during an intervention operation. In one embodiment, the intervention operation is optimized based on the measured operational parameters.

FIG. 1 is a schematic representation of an intervention tool 100 in accordance with one embodiment of the present invention. The intervention tool 100 may be configured to perform various intervention operations downhole, such as setting and retrieving plugs, opening and closing valves, cutting tubular elements, drilling through obstructions, performing cleaning and/or polishing operations, collecting debris, performing caliper runs, shifting sliding sleeves, performing milling operations, performing fishing operations, and other appropriate intervention operations. Some of these operations will be described in more detail in the paragraphs below.

In the embodiment of FIG. 1, the intervention tool 100 includes a head assembly 20, a communications module 30, a drive electronics module 40, a hydraulic power module 50, an anchoring system 60, and an intervention module 70, which may be defined as any device capable of performing an intervention operation.

The head assembly 20 may be configured to mechanically couple the intervention tool 100 to a wireline 10. In one embodiment, the head assembly 20 includes a sensor 25 for measuring the amount of cable tension between the wireline 10 and the head assembly 20. Although a wireline 10 is shown in FIG. 1, it should be understood that in other embodiments other deployment mechanisms may be used, such as a coiled tubing string, a slickline, or drilling pipe, among other appropriate deployment mechanisms.

The communications module 30 may be configured to receive and send commands and data which are transmitted in digital form on the wireline 10. This communication is used to initiate, control and monitor the intervention operation performed by the intervention tool. The communications module 30 may also be configured to facilitate this communication between the drive electronics module 40 and a surface system 160 at the well surface 110. Such communication will be described in more detail in the paragraphs below. As such, the communications module 30 may operate as a telemetry device.

The drive electronics module 40 may be configured to control the operation of the intervention module 70. The drive electronics module 40 may also be configured to control the hydraulic power module 50. As such, the drive electronics module 40 may include various electronic components (e.g., digital signal processors, power transistors, and the like) for controlling the operation of the intervention module 70 and/or the hydraulic power module 50.

In one embodiment, the drive electronics module 40 may include a sensor 45 for measuring the temperature of the electronics contained therein. In another embodiment, the drive electronics module 40 may be configured to automatically turn off or shut down the operation of the electronics if the measured temperature exceeds a predetermined maximum operating temperature.

The hydraulic power module 50 may be configured to supply hydraulic power to various components of the intervention tool 100, including the anchoring system 60 and the intervention module 70. The hydraulic power module 50 may include a motor, a pump and other components that are typically part of a hydraulic power system. In one embodiment, the hydraulic power module 50 includes one or more sensors 55 for measuring the amount of pressure generated by the hydraulic power module 50. In another embodiment, the one or more hydraulic power module sensors 55 are used to measure the temperature of the motor inside the hydraulic power module 50. The pressure and/or temperature measurements may then be forwarded to the drive electronics module 40.

In response to receiving the measurements from the one or more hydraulic power module sensors 55, the drive electronics module 40 may determine whether the measured temperature exceeds a predetermined maximum operating temperature. If it is determined that the measured temperature exceeds the predetermined maximum operating temperature, then the drive electronics module 40 may automatically shut down or turn off the motor inside the hydraulic power module 50 to avoid overheating. Likewise, the drive electronics module 40 may monitor the measured pressure and control the hydraulic power module 50 to maintain a desired output pressure.

Alternatively, the drive electronics module 40 may forward the pressure and/or temperature measurements made by the one or more hydraulic power module sensors 55 to the surface system 160 through the communications module 30. In response to receiving these measurements, an operator at the well surface 110 may monitor and/or optimize the operation of the hydraulic power module 50, e.g., by manually turning off the motor or the pump of the hydraulic power module 50. Although the intervention tool 100 is described with reference to a hydraulic power system, it should be understood that in some embodiments the intervention tool 100 may use other types of power distribution systems, such as an electric power supply, a fuel cell, or another appropriate power system.

The anchoring system 60 may be configured to anchor the intervention tool 100 to an inner surface of a wellbore wall 120, which may or may not include a casing, tubing, liner, or other tubular element. Alternatively, the anchoring system 60 may be used to anchor the intervention tool 100 to any other appropriate fixed structure or to any other device that the intervention tool 100 acts upon.

In one embodiment the anchoring system 60 includes a piston 62 which is coupled to a pair of arms 64 in a manner such that a linear movement of the piston 62 causes the arms 64 to extend radially outwardly toward the wellbore wall 120, thereby anchoring the intervention tool 100 to the wellbore wall 120. In one embodiment, the anchoring system 60 includes one or more sensors 65 for measuring the linear displacement of the piston 62, which may then be used to determine the extent to which the arms 64 have moved toward the wellbore wall 120, and therefore the radial opening of the wellbore. In another embodiment, the one or more anchoring system sensors 65 are used to measure the amount of pressure exerted by the arms 64 against the wellbore wall 120. In yet another embodiment, the one or more anchoring system sensors 65 are used to measure the slippage of the intervention tool 100 relative to the wellbore wall 120.

As with the measurements discussed above, the linear displacement, radial opening, pressure and/or slippage measurements made by the one or more anchoring system sensors 65 may be forwarded to the drive electronics module 40. In one embodiment, the drive electronics module 40 may forward those measurements to the surface system 160 through the communications module 30. Upon receipt of the measurements, the operator at the well surface 110 may then monitor, adjust and/or optimize the operation of the anchoring system 60.

In another embodiment, the drive electronics module 40 automatically adjusts or optimizes the operation of the anchoring system 60, such as by adjusting the linear displacement of the piston 62 so that the arms 64 may properly engage the wellbore wall 120 based on the linear displacement, radial opening, pressure and/or slippage measurements.

As briefly mentioned above, the intervention tool 100 includes an intervention module 70, which is capable of performing an intervention operation. In one embodiment, the intervention module 70 includes a linear actuator module 80 and a rotary module 90. The linear actuator module 80 may be configured to push or pull the rotary module 90.

In one embodiment, the linear actuator module 80 includes one or more sensors 85 for measuring the linear displacement of the linear actuator. In another embodiment, the one or more linear actuator sensors 85 are used to measure the amount of force exerted by the linear actuator module 80. As with other measurements discussed above, the linear displacement and/or force measurements made by the one or more linear actuator sensors 85 may be forwarded to the drive electronics module 40, which may then forward these measurements to the surface system 160 through the communications module 30. Upon receipt of the linear displacement and/or force measurements, the operator at the well surface 120 may monitor and/or optimize the operation of the linear actuator module 80.

In one embodiment, the drive electronics module 40 may automatically adjust the linear displacement of the linear actuator module 80 and the amount of force exerted by the linear actuator module 80 based on the linear displacement and/or force measurements made by the one or more linear actuator sensors 85.

The rotary module 90 may be configured to rotate any device or tool that may be attached thereto. In one embodiment, the rotary module 90 includes a sensor 95 for measuring the amount of torque exerted by the rotary module 90. In another embodiment, the one or more rotary module sensors 95 are used to measure the velocity (e.g., revolutions per minute (rpm)) of the rotary module 90. In yet another embodiment, the one or more rotary module sensors 95 are used to measure the temperature of the module 90. In still another embodiment, the one or more rotary module sensors 95 are used to measure the vibrations produced by the rotary module 90.

As with other measurements discussed above, the torque, velocity, temperature and/or vibration measurements made by the one or more rotary module sensors 95 may be forwarded to the drive electronics module 40, which may then forward those measurements to the surface system 160 through the communications module 30. Upon receipt of the torque, velocity, temperature and/or vibration measurements, the operator at the well surface 120 may monitor and/or optimize the operation of the rotary module 90. In one embodiment, the drive electronics module 40 may automatically optimize the operation of rotary module 90 based on the torque, velocity, temperature and/or vibration measurements.

In one embodiment, a tractor is disposed between the communications module 30 and the drive electronics module 40 to deploy the intervention tool 100 downhole. Once the intervention tool 100 has been set at a desired location in the wellbore 120, the tractor may be turned off. In this manner, the intervention tool 100 may be modular.

In FIG. 1, the intervention tool 100 includes a linear actuator module 80 coupled to a rotary module 90. FIG. 2 shows an intervention tool 100' having an intervention module 70', wherein the rotary module 90 is replaced with another intervention accessory 130. The intervention accessory 130 may be any accessory capable of performing an intervention operation. For example, exemplary intervention accessories 130 include a shifting tool used to engage a sliding feature in a completions device, a debris remover (e.g., a wire brush) or collector, a milling or drilling head, a hone, a fishing head, a welding tool, a forming tool, a fluid injection system, or any combination thereof among other appropriate accessories.

The shifting tool may be configured to open and close sliding sleeves, formation isolation valves, and other flow control devices used in well completions. The debris remover may be configured to dislodge cement, scale, and the like from the inside wall of the tubing. The debris collector may be configured to collect sand, perforating residue and other debris from the inside of the tubing or casing. The milling or drilling head may be configured to mill and drill downhole obstructions, e.g., plugs, scale bridges and the like. The hone may be configured to polish seal bores.

FIG. 3 shows an intervention tool 100" having an intervention module 70", wherein an intervention accessory 140 is attached to an articulated rotary shaft 150, which may be used to angle the accessory 140 away from the longitudinal axis of the tool 100". Such an articulated rotary shaft 150 facilitates some intervention operations such as milling windows or machining other features in a wellbore casing. In one embodiment, the articulated rotary shaft 150 includes one or more sensors 155 for measuring the angle of inclination of the rotary shaft, the angular orientation of the offset, and/or the side force applied by the articulated rotary shaft. The sensors 155 may additionally, or alternatively, be used for acquiring still or moving images of the operation being performed.

In this manner, while an intervention operation is being performed downhole, any of the various measurements described above regarding the intervention operation may be made and communicated within the intervention tool 100, 100', 100". Based on these measurements, the intervention tool 100, 100', 100" may automatically adjust the operating parameters of the various modules or accessories to which the measurements relate.

Alternatively, any of the various measurements described above regarding the intervention operation may be communicated to the surface system 160, which allows an operator to monitor the progress of the intervention operation and to optimize the intervention operation, if necessary. This optimization may be performed by the surface system 160 either automatically or manually. In one embodiment, any of the various measurements described above regarding the intervention operation may be communicated to the surface system 160 in real time. In another embodiment, any of the various measurements described above regarding the intervention operation may be recorded for later retrieval either in the intervention tool 100, 100', 100" or in the surface system 160.

Note that while the above embodiments of the intervention tool 100, 100', 100" are shown in a vertical well, the above described embodiments of the intervention tool 100, 100', 100" may be used in horizontal or deviated wells as well.

While the foregoing is directed to implementations of various technologies described herein, other and further implementations may be devised without departing from the basic scope thereof, which may be determined by the claims that follow. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

The invention claimed is:

1. An intervention tool comprising:

an intervention module capable of performing an intervention operation downhole within a previously drilled wellbore;

a drive electronics module in communication with the intervention module and configured to control the intervention module;

one or more sensors which measure at least one operational parameter of the intervention operation during the intervention operation;

a head assembly which couples the intervention tool to a deployment device;

wherein the intervention operation is optimized based on the measured at least one operational parameter; and wherein the one or more sensors measure an amount of tension between the head assembly and the deployment device.

2. The intervention tool of claim 1, wherein the intervention operation is automatically optimized based on the measured at least one operational parameter.

3. The intervention tool of claim 1, wherein the drive electronics module automatically optimizes the intervention operation of the intervention module based on the measured at least one operational parameter.

4. The intervention tool of claim 1, wherein the one or more sensors measure a temperature of the drive electronics module.

5. The intervention tool of claim 4, wherein the drive electronics module automatically terminates operation of itself when the measured temperature exceeds a predetermined maximum operating temperature.

6. The intervention tool of claim 1, further comprising a communications module in communication with the drive electronics module and configured to facilitate communications between the drive electronics module and a surface system at the surface of the wellbore; and wherein the communications module is further configured to send the measured at least one operational parameter to the surface system during the intervention operation.

7. The intervention tool of claim 6, wherein the surface system optimizes the intervention operation of the intervention module based on the measured at least one operational parameter.

8. The intervention tool of claim 7, wherein the surface system is manually operated by an operator at the well surface.

9. The intervention tool of claim 6, wherein the surface system automatically optimizes the intervention operation of the intervention module based on the measured at least one operational parameter.

10. The intervention tool of claim 1, further comprising an anchoring system in communication with the drive electronics module, and wherein the one or more sensors measure at least one of a pressure exerted by the anchoring system against an inside wall of the wellbore, a radial opening of the wellbore, and a slippage of the anchoring system relative to the inside wall of the wellbore.

11. The intervention tool of claim 1, further comprising a power module in communication with the drive electronics module, wherein the power module powers the intervention module, and wherein the one or more sensors measure at least one of a temperature of the power module and a pressure generated by the power module.

12. The intervention tool of claim 11, wherein the drive electronics module is further configured to terminate operation of the power module when the measured temperature of the power module exceeds a predetermined maximum operating temperature.

13. The intervention tool of claim 1, wherein the intervention module is chosen from the group consisting of a shifting tool, a debris remover, a debris collector, a wire brush, a milling head, a drilling head, a hone, a fishing head, a welding tool, a forming tool, and a fluid injection system.

14. The intervention tool of claim 1, wherein the intervention operation is chosen from the group consisting of setting a plug, retrieving a plug, opening a valve, closing a valve, cutting a tubular element, drilling through an obstruction, performing a cleaning operation, performing a polishing operation, collecting debris, removing debris, performing a caliper run, shifting a sliding sleeve, performing a milling operation, and performing a fishing operation.

15. An intervention tool comprising:

an intervention module capable of performing an intervention operation downhole within a previously drilled wellbore;

a drive electronics module in communication with the intervention module and configured to control the intervention module;

one or more sensors which measure at least one operational parameter of the intervention operation during the intervention operation;

wherein the intervention operation is optimized based on the measured at least one operational parameter;

wherein the intervention module comprises a linear actuator and an intervention accessory coupled to the linear actuator; wherein the linear actuator is configured to linearly displace the intervention accessory; and wherein the one or more sensors measure at least one of a linear displacement and an amount of force exerted by the linear actuator; and wherein the intervention accessory is a rotary module, and wherein the one or more sensors measure at least one of a torque, a velocity, a temperature, and a vibration of the rotary module.

16. A method for performing an intervention operation comprising:

providing an intervention tool comprising one or more sensors;

deploying the intervention tool downhole to a desired location in a previously drilled wellbore;

operating the intervention tool to perform an intervention operation within the previously drilled wellbore;

measuring at least one operational parameter during the intervention operation by use of the one or more sensors;

optimizing the intervention operation based on the measured at least one operational parameter;

providing the intervention tool with a head assembly; and coupling the head assembly to a deployment device, wherein said measuring comprises measuring an amount of tension between the head assembly and the deployment device.

17. The method of claim 16, further comprising providing a system, wherein said optimizing is automatically performed by the system based on the measured at least one operational parameter.

18. The method of claim 16, further comprising providing the intervention tool with a drive electronics module, and wherein said optimizing is automatically performed by the drive electronics module based on the measured at least one operational parameter.

19. The method of claim 16, further comprising providing the intervention tool with a drive electronics module that controls the intervention operation, and wherein said measuring comprises measuring a temperature of the drive electronics module.

20. The method of claim 19, further comprising automatically terminating the intervention operation when the measured temperature of the drive electronics module exceeds a predetermined maximum operating temperature.

21. The method of claim 16, further comprising sending the measured at least one operational parameter to a surface system at the surface of the wellbore during the intervention operation.

22. The method of claim 21, wherein said optimizing is performed by the surface system based on the measured at least one operational parameter.

23. The method of claim 22, further comprising manually operating the surface system.

24. The method of claim 21, wherein said optimizing is automatically performed by the surface system based on the measured at least one operational parameter.

25. The method of claim 16, further comprising providing the intervention tool with an anchoring system, and wherein said measuring comprises measuring at least one of a pressure exerted by the anchoring system against an inside wall of the wellbore, a radial opening of the wellbore, and a slippage of the anchor relative to the inside wall of the wellbore.

26. The method of claim 16, further comprising providing the intervention tool with a power module that powers the intervention tool, and wherein said measuring comprises measuring at least one of a temperature of the power module and a pressure generated by the power module.

27. The method of claim 26, further comprising automatically terminating operation of the power module when the measured temperature of the power module exceeds a predetermined maximum operating temperature.

28. The method of claim 16, wherein the intervention tool comprises an intervention module chosen from the group consisting of a shifting tool, a debris remover, a debris collector, a wire brush, a milling head, a drilling head, a hone, a fishing head, a welding tool, a forming tool, and a fluid injection system.

29. The method of claim 16, wherein the intervention operation is chosen from the group consisting of setting a plug, retrieving a plug, opening a valve, closing a valve, cutting a tubular element, drilling through an obstruction, performing a cleaning operation, performing a polishing operation, collecting debris, removing debris, performing a caliper run, shifting a sliding sleeve, performing a milling operation, and performing a fishing operation.

30. A method for performing an intervention operation comprising:

providing an intervention tool comprising one or more sensors;

deploying the intervention tool downhole to a desired location in a previously drilled wellbore;

operating the intervention tool to perform an intervention operation within the previously drilled wellbore;

measuring at least one operational parameter during the intervention operation by use of the one or more sensors;

monitoring the progress of the intervention operation based on the measured at least one operational parameter;

providing the intervention tool with a head assembly; and coupling the head assembly to a deployment device, wherein said measuring comprises measuring an amount of tension between the head assembly and the deployment device.

31. The method of claim 30, further comprising sending the measured at least one operational parameter to a surface system at the surface of the wellbore during the intervention operation.

32. A method for performing an intervention operation comprising:

providing an intervention tool comprising one or more sensors;

deploying the intervention tool downhole to a desired location in a previously drilled wellbore;

operating the intervention tool to perform an intervention operation within the previously drilled wellbore;

measuring at least one operational parameter during the intervention operation by use of the one or more sensors;

monitoring the progress of the intervention operation based on the measured at least one operational parameter;

providing the intervention tool with a linear actuator and a intervention module, and coupling the linear actuator to the intervention module in a manner that allows for linear displacement of the intervention module by the linear actuator, wherein said measuring comprising measuring at least one of a linear displacement of the linear actuator and an amount of force exerted by the linear actuator; and wherein the intervention module is a rotary module, and wherein said measuring further comprises measuring at least one of a torque, a velocity, a temperature, and a vibration of the rotary module.

33. A method for performing an intervention operation comprising:

providing an intervention tool comprising one or more sensors;

deploying the intervention tool downhole to a desired location in a wellbore;

operating the intervention tool to perform an intervention operation in a portion of the wellbore created by a prior wellbore drilling operation;

measuring at least one operational parameter during the intervention operation by use of the one or more sensors;

optimizing the intervention operation based on the measured at least one operational parameter;

providing the intervention tool with a head assembly; and coupling the head assembly to a deployment device, wherein said measuring comprises measuring an amount of tension between the head assembly and the deployment device.

34. A method for performing an intervention operation comprising:

providing an intervention tool comprising one or more sensors;

deploying the intervention tool downhole to a desired location in a wellbore;

operating the intervention tool to perform an intervention operation in a portion of the wellbore after wellbore drilling in said portion has been completed;

measuring at least one operational parameter during the intervention operation by use of the one or more sensors;

optimizing the intervention operation based on the measured at least one operational parameter;

providing the intervention tool with a head assembly; and coupling the head assembly to a deployment device, wherein said measuring comprises measuring an amount of tension between the head assembly and the deployment device.

* * * * *